US005638566A

United States Patent [19]

Wu

[11] Patent Number: 5,638,566

[45] Date of Patent: Jun. 17, 1997

[54] COMBINED WRITING INSTRUMENT/TOOL HOLDER

[76] Inventor: Jung-Chung Wu, No. 12, Alley 72, Guu Bao Street, Tainan City, Taiwan

[21] Appl. No.: 551,328

[22] Filed: Nov. 1, 1995

[51] Int. Cl.[6] ..... B26B 11/00; B25G 3/30

[52] U.S. Cl. ..... 7/167; 7/160; 7/162; 7/165; 7/118; 81/438; 81/177.4

[58] Field of Search ..... 81/437–439, 177.4, 81/490; 7/118, 158, 160, 161, 162, 165, 167, 170; 30/123, 142, 143

[56] References Cited

U.S. PATENT DOCUMENTS 495,784 4/1893 Coffin ..... 7/160 X
686,424 11/1901 Smith ..... 7/165 X
1,368,944 2/1921 Kurose ..... 7/160 X
1,955,419 4/1934 Gerard ..... 7/167 X

*Primary Examiner*—D. S. Meislin
*Attorney, Agent, or Firm*—Morton J. Rosenberg; David I. Klein

[57] ABSTRACT

A multifunctional instrument includes a plurality of holder units which are detachably mounted in series and connecting members which may be either mounted between and interconnecting two adjacent holder units or mounted to a distal end of interconnected holder units, each interconnecting member including engaging arrangement at two ends thereof for detachably engaging with two ends of the holder units, and different kinds of tool tips being formed on two ends of the interconnecting member.

5 Claims, 5 Drawing Sheets

COMBINED WRITING INSTRUMENT/TOOL HOLDER

BACKGROUND OF THE INVENTION

1. Field of the Invention

The present invention relates to a combined writing instrument/tool holder and, more particularly, to holder units which may carry different kinds of tool tips, such as screw driver blades having different types of tips and knife blades as well as writing elements and which can be interconnected to form a combined writing instrument/tool holder.

2. Description of Related Art

Tools, such as screw drivers, and writing instruments belong to different categories in daily use, and many people almost use both of them everyday. The present invention is intended to provide a novel design which may serve as a writing instrument and also carry different kinds of tools to provide convenience to users.

SUMMARY OF THE INVENTION

The present invention provides a combined writing instrument/tool holder, i.e., a multifunctional instrument which includes first, second, and third holder units each having first and second ends and a longitudinal threaded hole extending therethrough, a first interconnecting means mounted between and thus interconnecting the first and second holder units, and a second interconnecting means mounted between and thus interconnecting the second and third holder units.

The first interconnecting means includes a main body and first and second shanks respectively extending from two sides of the main body, the first shank of the first interconnecting means having a first tool tip formed on a distal end thereof and a first threaded portion defined in an outer periphery thereof adjacent to the main body for releasable threading connection with the first end of the first holder unit, the second shank of the first interconnecting means having a second tool tip formed on a distal end thereof and a second threaded portion defined in an outer periphery thereof adjacent to the main body for releasable threading connection with the first end of the second holder unit.

The second interconnecting means includes a main body and third and fourth shanks respectively extending from two sides of the main body, the third shank of the second interconnecting means having a third tool tip formed on a distal end thereof and a third threaded portion defined in an outer periphery thereof adjacent to the main body for releasable threading connection with the second end of second holder unit, the fourth shank of the second interconnecting means having a fourth tool tip formed on a distal end thereof and a fourth threaded portion defined in an outer periphery thereof adjacent to the main body for releasable threading connection with the first end of the third holder unit.

The instrument further includes a chuck means comprising a threaded first end releasably mounted to the second end of the third holder unit and a chuck formed on a second end thereof for releasably mounting a fifth tool tip thereon, and a chuck sleeve removably mounted therearound for positioning the fifth tool tip.

The instrument may further includes a second chuck means which comprises a threaded mediate section releasably mounted to the second end of the first holder unit, a first end with a hooked portion formed thereon, and a chuck formed on a second end thereof for releasably mounting a sixth tool tip therein, and a chuck sleeve releasably mounted therearound for positioning the sixth tool tip.

Preferably, each holder unit has at least one longitudinal receptacle defined therein for receiving a knife blade or the like.

Preferably, the tool tips are different from one another.

The instrument may further include a substantially U-shaped bracket comprising a main section having a hole defined therein through which the mediate threaded portion of the second chuck means extends, a first limb extending from a first end of the main section and having knurls defined in an outer side thereof to serve as a nail file, and a second limb extending from a second end of the main section and having anti-slip ridges defined in an inner side thereof to serve as a clip.

Other objects, advantages, and novel features of the invention will become more apparent from the following detailed description when taken in conjunction with the accompanying drawings.

DESCRIPTION OF THE PREFERRED EMBODIMENT

Before entering the body text of the description of the preferred embodiment, it is appreciated that the present invention includes a plurality of holder units and interconnecting members to form a combined writing instrument/tool holder, i.e., the combined writing instrument/tool holder may serve as a writing instrument and carry therewith different kinds of tool tips.

Figure 1:
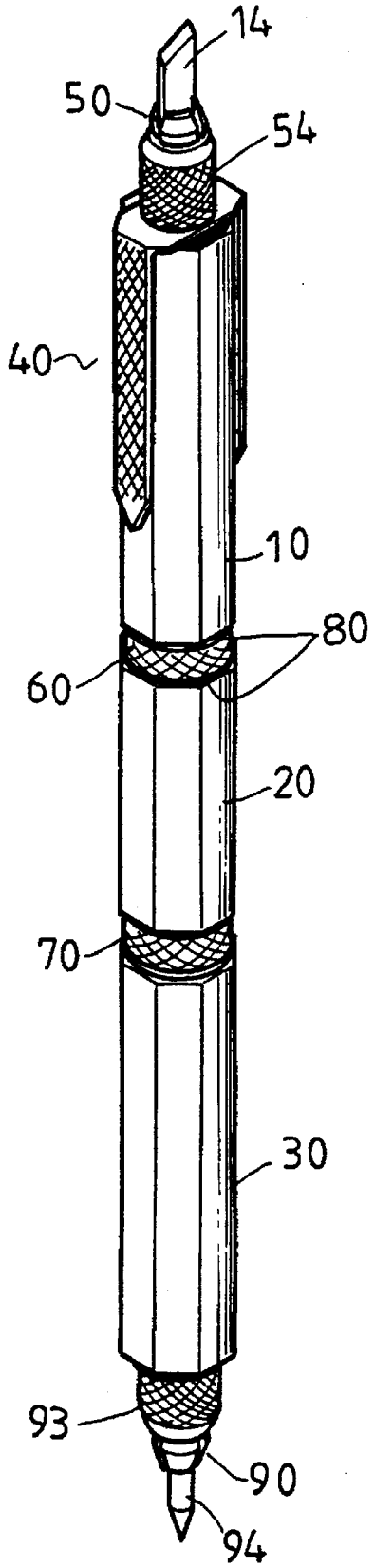
FIG. 1 is a perspective view of a combined writing instrument/tool holder in accordance with the present invention.
Figure 2:
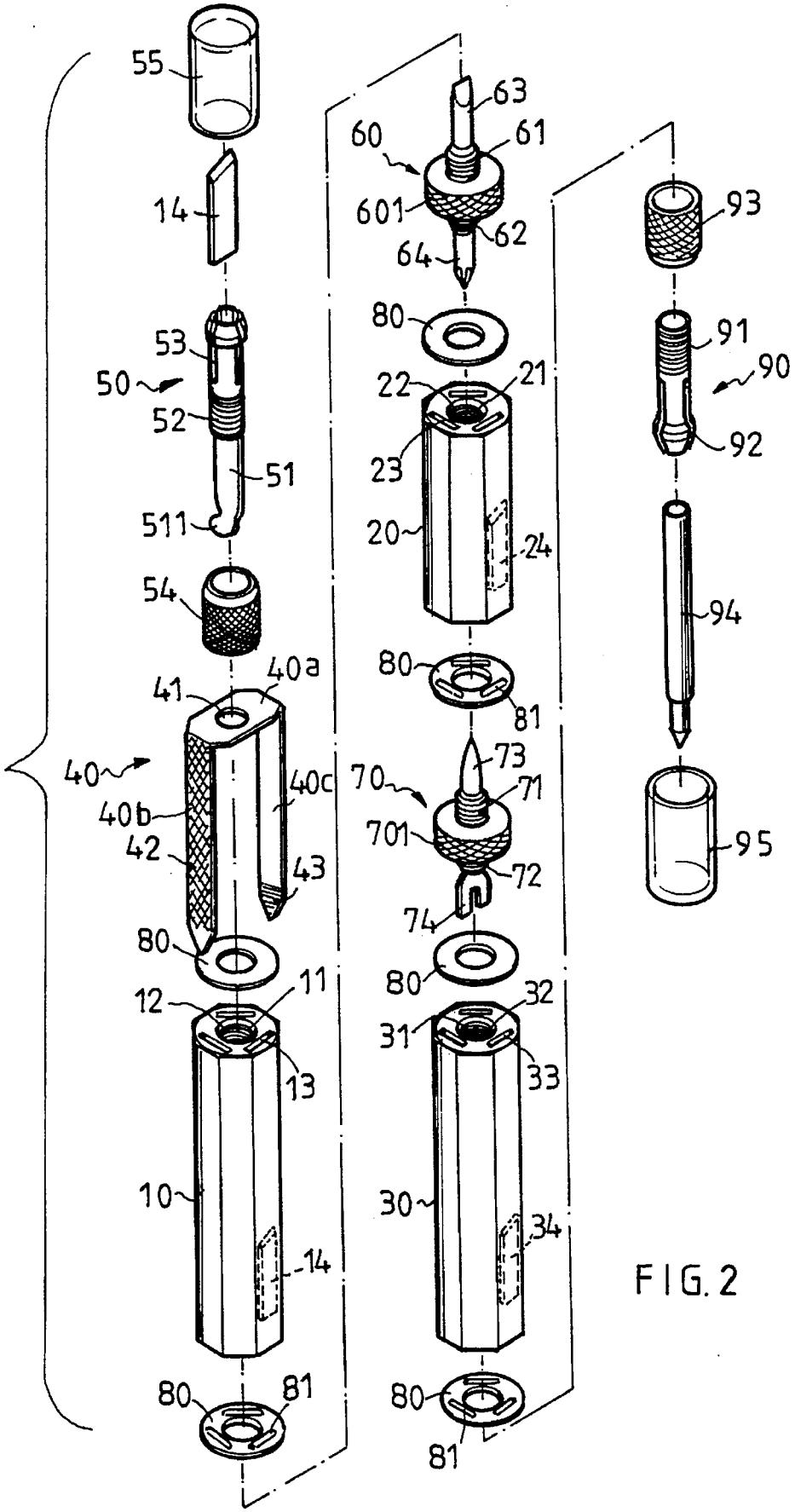
FIG. 2 is an exploded view of the combined writing instrument/tool holder in accordance with the present invention.
Figure 3:
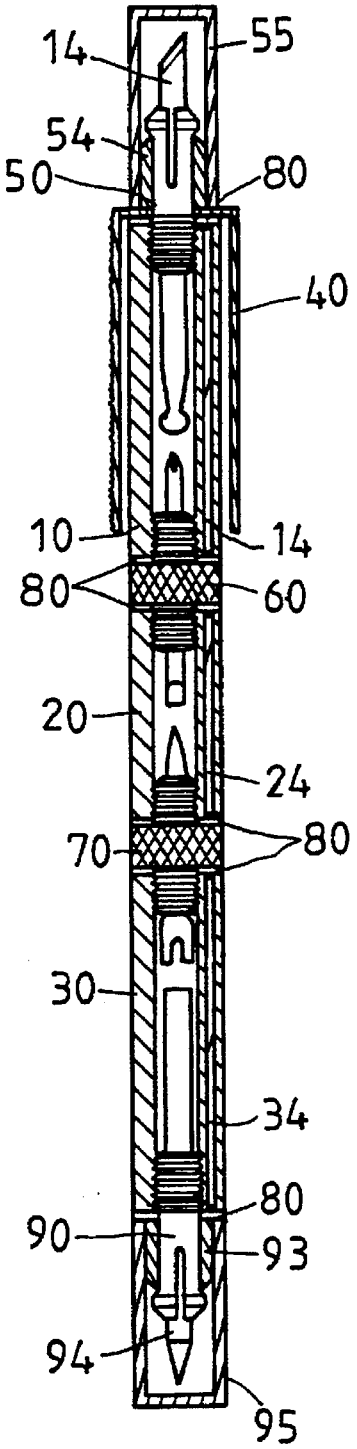
FIG. 3 is a cross-sectional view of the combined writing instrument/tool holder.

Referring now to FIGS. 1 through 3, a combined writing instrument/tool holder in accordance with the present invention includes first, second, and third holder units 10, 20, and 30, a bracket 40, chuck means 50 and 90, and interconnecting means 60 and 70.

The first, second, and third holder units 10, 20, and 30 are identical and each of which includes a central threaded hole 11, 21, 31 extending therethrough (see threadings 12, 22, and 32). Preferably, each holder unit 10, 20, 30 is hexagonal and includes at least one receptacle 13, 23, 33 defined therein and extending in a longitudinal direction thereof for receiving knife blades 14, 24, 34 or the like for replacement or other uses.

Figure 6:
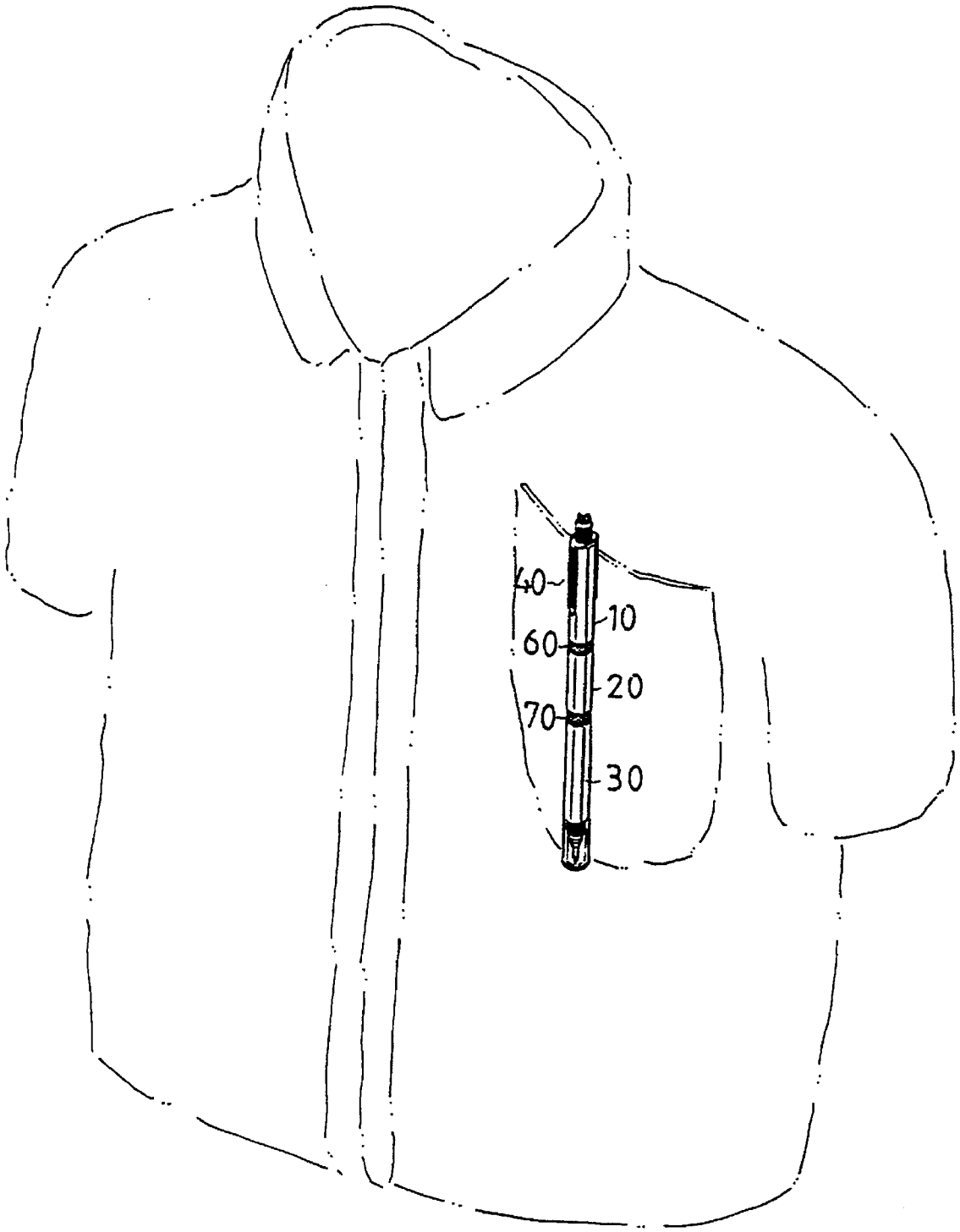
FIG. 6 is a schematic illustration of the combined writing instrument/tool holder attached to a pocket of a shirt.

The bracket 40 is substantially U shaped and has a main section 40*a* having a hole 41 therein and two limbs 40*b* and 40*c* respectively extending from two ends of the main section 40*a*. The limb 40*b* includes knurls 42 formed on an outer side thereof and thus may serve as a nail file if desired, while the limb 40*c* includes anti-slip ridges 43 formed on an inner side thereof and thus may serve as a clip for attachment to a pocket of a shirt of a user, as shown in FIG. 6.

The chuck means 50 includes a threaded mediate section 52, a first end 51 with a hooked portion 511 formed thereon, and a second end which is hollow and has cross-like slits defined therein to form a chuck 53. The chuck means 50 further includes a chuck sleeve 54 mounted therearound for releasably positioning a tool tip. The chuck means 90 includes a threaded first end 91 and a second end which is hollow and has cross-like slits defined therein to form a chuck 92. The chuck means 90 also includes a chuck sleeve 93 mounted therearound for releasably positioning a tool tip.

The interconnecting means 60 includes a substantially cylindrical main body 601 and first and second kinds of tool end portions (such as a screw driver blade having a cabinet tip 63 and a screw driver blade having a Phillips head tip 64) respectively formed on two sides of the cylindrical main body 601. Threadings 61 and 62 are respectively defined on the shanks of the screw drivers 63 and 64 for releasable engagement with threaded holes 11 and 21. Similarly, the interconnecting means 70 includes a substantially cylindrical main body 701 and third and fourth kinds of tool end portions (such as a pricker 73 and a fork 74) respectively formed on two sides of the cylindrical main body 701. Threadings 71 and 72 are respectively defined on the shanks of the pricker 73 and the fork 74 for releasable engagement with threaded holes 21 and 31.

In assembly, still referring to FIGS. 1 through 3, the bracket 40 is mounted to an upper end of the first holder unit 10. Then, the first end 51 of the chuck mean 50 is passed through the hole 41 in the bracket 40 and thus positioned in the threaded hole 11 in the first holder unit by means of threading connection (52 and 12). Thereafter, a suitable tool (such as the knife blade 14) is mounted to the chuck 53, and the chuck sleeve 54 is subsequently mounted around the chuck 53 to secure the knife blade 14 in position. Thereafter, a cap 55 is removably mounted to enclose the knife blade 14 when not in use. Preferably, a washer 80 is mounted to each of two ends of the first holder unit 10 and includes a corresponding number of protrusions 81 formed thereon which fittingly closes the receptacle 13 in the first holder unit 10, thereby preventing the knife blade 14 received in the receptacle 13 from being lost.

Similarly, two further washers 80 are respectively mounted to two ends of the second holder unit 20, and the interconnecting means 60 is mounted between and thus interconnects the first and second holder units 10 and 20 by means of threading connection (61 and 12, 62 and 22).

Again, two further washers 80 are respectively mounted to two ends of the third holder unit 20, and the interconnecting means 70 is mounted between and thus interconnects the second and third holder units 20 and 30 by means of threading connection (73 and 22, 72 and 32). Furthermore, the first end 91 of the chuck mean 90 is positioned in the threaded hole 31 in the third holder unit 30 by means of threading connection (91 and 32). Thereafter a suitable tool (such as the core 94 for writing) is mounted to the chuck 92, and the chuck sleeve 93 is subsequently mounted around the chuck 92 to secure the core 94 in position. Thereafter, the cap 95 is removably mounted to enclose the core 94 when not in use.

The final assembled device is thus completed, which is compact and portable and may serve as a writing instrument and carry different kinds of tools therewith.

Figure 4:
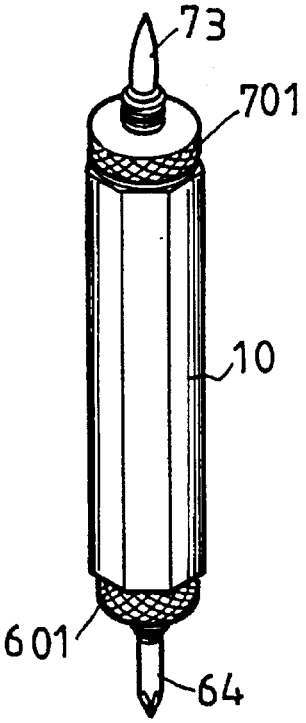
FIG. 4 is a perspective view illustrating a holder unit holding tool tips thereon.
Figure 5:
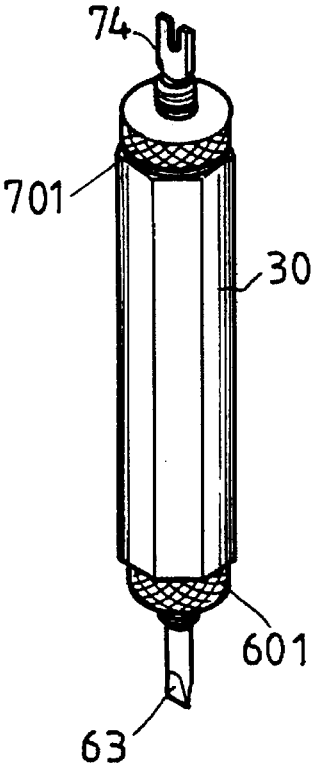
FIG. 5 is a perspective view illustrating a holder unit holding tool tips of another types thereon.

It is appreciated that the holder units 10, 20, 30 may serve as an independent tool when combined with the interconnecting means 60 and 70. FIG. 4 illustrates the first holder unit 10 having the interconnecting means 60 and 70 mounted to two ends thereof and may be used as a pricker 73 and a screw driver having a Phillips head tip 64, while FIG. 5 illustrates the third holder unit 30 having the interconnecting means 60 and 70 mounted to two ends thereof and may be used as a fork 74 and a screw driver having a cabinet tip 64.

Figure 7:
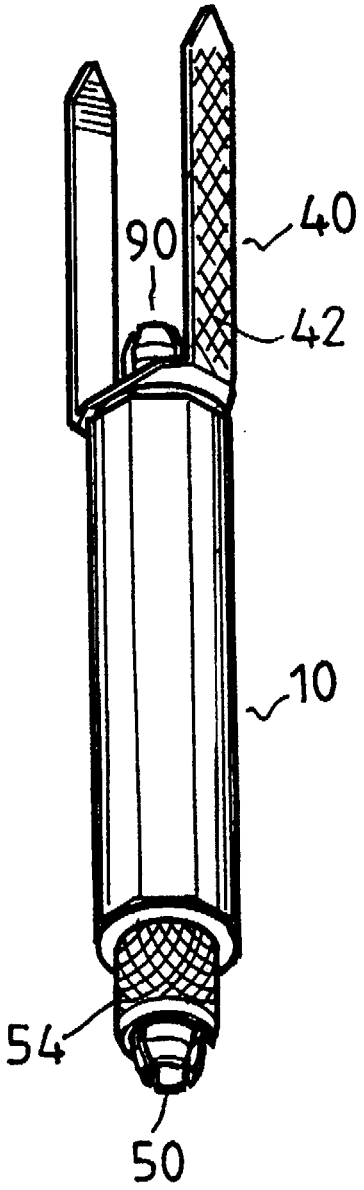
FIG. 7 is a perspective view illustrating a different combination in accordance with the present invention.

FIG. 7 illustrates a different combination in which the chuck means 90 and the bracket 40 is mounted to one end of the first holder unit 10 while the chuck means 50 is mounted to the other end of the first holder unit 10. The clip 40 may serve as a fork in addition to the nail file function mentioned above (see knurls 42). As described above, the chuck means 90 and 50 may have a tool or writing core attached thereto for different uses. Furthermore, the hooked portion 511 of the chuck means 50 may serve as an ear-pick.

Although the engagement between the holder units 10, 20, 30 and the interconnecting means 60, 70 are illustrated in the form of threading connection, it is appreciated that other types of releasable engagement arrangement also can be used without departing from the spirit of the invention.

According to the above description, it is appreciated that the resultant device can be as long as possible dependent upon the needs and is compact and convenient to carry, and the assembly thereof is simple. Furthermore, people having different jobs may select the required combination, and re-combination is simple and can be quickly completed.

Although the invention has been explained in relation to its preferred embodiment, it is to be understood that many other possible modifications and variations can be made without departing from the spirit and scope of the invention as hereinafter claimed.

What is claimed is:

1. A multifunctional instrument comprising:

first, second, and third holder units each having first and second ends and a longitudinal threaded hole extending therethrough;

a first interconnecting means mounted between and thus interconnecting the first and second holder units, comprising a main body with two sides and first and second shanks respectively extending from two sides of the main body, said first shank of said first interconnecting means having a first tool tip formed on a distal end thereof and a first threaded portion defined in an outer periphery thereof adjacent to the main body for releasable threading connection with the first end of the first holder unit, said second shank of said first interconnecting means having a second tool tip formed on a distal end thereof and a first threaded portion defined in an outer periphery thereof adjacent to the main body for releasable threading connection with the first end of the second holder unit;

a second interconnecting means mounted between and thus interconnecting the second and third holder units, comprising a main body with two sides and third and fourth shanks respectively extending from two sides of the main body, said third shank of said second interconnecting means having a third tool tip formed on a distal end thereof and a third threaded portion defined in an outer periphery thereof adjacent to the main body for releasable threading connection with the second end of second holder unit, said fourth shank of said second interconnecting means having a fourth tool tip formed on a distal end thereof and a fourth threaded portion defined in an outer periphery thereof adjacent to the main body for releasable threading connection with the first end of the third holder unit; and a chuck means comprising a threaded first end releasably mounted to the second end of the third holder unit and a chuck formed on a second end thereof for releasably mounting a fifth tool tip thereon, and a chuck sleeve removably mounted therearound for positioning the fifth tool tip.

2. The instrument as claimed in claim 1, further comprising a second chuck means comprising a threaded mediate section releasably mounted to the second end of the first holder unit, a first end with a hooked portion formed thereon, and a chuck formed on a second end thereof for releasably mounting a sixth tool tip thereon, and a second chuck sleeve releasably mounted therearound for positioning a sixth tool tip.

3. The instrument as claimed in claim 1, wherein each said holder unit has at least one longitudinal receptacle defined therein.

4. The instrument as claimed in claim 1, wherein the first, second, third, and fourth tool tips are different from one another.

5. The instrument as claimed in claim 2, further comprising a substantially U-shaped bracket comprising a main section having first and second ends and a hole defined therein through which the mediate threaded portion of the second chuck means extends, a first limb extending from the first end of the main section and having knurls defined in an outer side thereof, and a second limb extending from the second end of the main section and having anti-slip stripes defined in an inner side thereof.

* * * * *